US006000722A

United States Patent [19]

Werner et al.

[11] Patent Number: 6,000,722

[45] Date of Patent: Dec. 14, 1999

[54] DEVICE FOR BINDING AND PROTECTING SHEET-LIKE ARTICLES

[75] Inventors: Richard S. Werner, West Bend, Wis.; Serge Marini, Nice, France

[73] Assignee: Richard Werner, West Bend, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/799,082

[22] Filed: Feb. 11, 1997

Related U.S. Application Data

[63] Continuation of application No. 08/799,082, Feb. 11, 1997, abandoned, which is a continuation of application No. 08/477,235, Jun. 6, 1995, abandoned, which is a continuation-in-part of application No. 08/426,238, Apr. 21, 1995, abandoned.

[51] Int. Cl.[6] ..... B42D 3/00

[52] U.S. Cl. ..... 281/29; 281/15.1; 281/21.1; 281/32; 281/37

[58] Field of Search ..... 281/15.1, 29, 21.1, 281/32, 37

[56] References Cited

U.S. PATENT DOCUMENTS

| | | |
|---|---|---|
| 395,155 | 12/1888 | Lipman . |
| 848,680 | 4/1907 | Nelson . |
| 864,984 | 9/1907 | McPhee . |
| 1,661,070 | 2/1928 | Hendricks . |
| 1,765,194 | 6/1930 | Von Auw . |
| 2,040,251 | 5/1936 | Fabry . |
| 2,244,246 | 6/1941 | Esterly . |
| 2,302,153 | 11/1942 | Spinner . |
| 2,359,473 | 10/1944 | Fry . |
| 3,188,114 | 6/1965 | O'Brien et al. . |
| 3,833,244 | 9/1974 | Heimann . |
| 4,083,582 | 4/1978 | Villafana . |
| 4,673,324 | 6/1987 | Hanson et al. . |
| 4,762,341 | 8/1988 | Rabuse . |
| 4,832,369 | 5/1989 | Johnson et al. . |
| 4,941,791 | 7/1990 | Iwamoto . |
| 5,015,011 | 5/1991 | York . |
| 5,236,226 | 8/1993 | Sheffield . |
| 5,360,234 | 11/1994 | Miller et al. . |

*Primary Examiner*—Willmon Fridie, Jr.
*Assistant Examiner*—Monica Smith
*Attorney, Agent, or Firm*—Jansson, Shupe, Bridge & Munger, Ltd.

[57] ABSTRACT

A device is disclosed for binding together sheet-like articles such as photos or documents. In combination, the device includes a first cover and a second and a plurality of sheet-like articles interposed between the covers and secured therebetween by adhesive. A first closure member is secured with respect to the first cover and the second cover includes a second closure member coacting with the first closure member, whereby the closure members secure the covers in an article-protecting relationship.

4 Claims, 5 Drawing Sheets

DEVICE FOR BINDING AND PROTECTING SHEET-LIKE ARTICLES

RELATED APPLICATIONS

This application is a continuation of application Ser. No. 08/799,082 filed on Feb. 11, 1997 and now abandoned, which in turn is a continuation of application Ser. No. 08/477,235 filed on Jun. 6, 1995 and now abandoned, which in turn is a continuation-in-part of application Ser. No. 08/426,238 filed on Apr. 21, 1995, and now abandoned.

FIELD OF THE INVENTION

This invention relates generally to bookbinding and, more particularly, to binding using adhesives.

BACKGROUND OF THE INVENTION

Binding together of sheet-like articles such as pages of a book may be accomplished in a number of ways. Some are relatively complex and require machinery. Of course, commercial bookbinders (for either new books or books under repair) usually employ such machinery and pages are permanently bound in the book.

On the other hand, there are situations where it is desirable to bind sheet-like articles together but acquisition of bookbinding machinery is out of the question or at least not warranted. For example, persons who take or otherwise obtain candid photographs often find it desirable to bind such photos between covers to form a book-like arrangement.

Such an arrangement protects the photos, helps prevent loss and retains the order of arrangement. The latter may be important in, say, describing a sequence of events such as a vacation trip. U.S. Pat. No. 4,941,791 (Iwamoto) depicts a binder said to be useful to hold together post cards, photos, business cards and the like.

But photographs are not the only type of sheet-like article to be bound together in aligned, stacked arrangement. U.S. Pat. Nos. 848,680 (Nelson); 1,765,194 (Von Auw); 3,188,114 (O'Brien et al.) and 4,673,324 (Hanson et al.) all depict ways to bind together other types of such articles, e.g., writing tablet sheets, business forms and the like.

Many such binders and arrangements provide for removal and reinsertion of articles into the binder devices or arrangements. This is often accomplished by use of a releasable adhesive to bind the edges of the articles. Such releasable adhesive allows for removal and reinsertion of individual sheets, e.g., photographs, paper, post cards and the like.

While the prior art arrangements have been generally suitable for their intended purposes, some tend to be characterized by certain disadvantages. This is particularly true with respect to self-applied, pressure-adhering devices used by "amateur binders," e.g., persons wishing to bind photos of their grandchildren.

Common problems encountered include loosening or loss of one or more of the sheet-like articles. Such loosening or loss of the articles may result from adhesive failure. After time adhering tend to lose their adhesive. Harsh treatment of the bound arrangement can also loosen sheets. Additionally, repeated use can reduce the adhesive properties of an adhesive.

Further, improper binding can cause loosening or loss of sheet-like articles. Often, when binder arrangements are applied, the strip including the adhesive is "out of square" when applied and does not fully contact and secure the edges of the articles being bound. Additionally, the strip may not be straight along the aligned edges of the articles being bound, the strip may have a fold or crease along it and does not contact and secure the articles to be bound as well as possible.

And as the articles become larger (or at least where the corresponding edge of the article become longer), flawed binding becomes more likely.

Further, binder arrangements typically include covers that are the same size as the articles being bound, particularly where photographs are being bound. This results in the unbound, free edges of the articles being left exposed to damage from contact with surfaces and objects resulting in bending and mutilation of the free edges of the bound articles.

A new arrangement or device which addresses some of these disadvantages would be an important advance in the art.

OBJECTS OF THE INVENTION

It is an object of the invention to provide a device for binding sheet-like articles which overcomes some of the problems and shortcomings of the prior art.

Another object of the invention is to provide a device for binding sheet-like articles wherein the resulting "assembly" more positively retains such articles.

Another object of the invention is to provide a device for binding sheet-like articles wherein loss of the articles is prevented.

Still another object of the invention is to provide a device for binding sheet-like articles wherein the edges of the articles are protected from damage.

How these and other objects are accomplished will become more apparent from the following descriptions and from the drawings.

SUMMARY OF THE INVENTION

The invention involves a device for binding sheet-like articles such as candid photographs, documents and the like. The novel device, in combination, includes a first cover, a second cover and a plurality of sheet-like articles interposed between the covers. The sheet-like articles are secured between the covers by adhesive. A first closure member is secured with respect to the first cover and the second cover includes a second closure member. The closure members coact to secure the covers in an article-protecting relationship.

In one embodiment the adhesive is disposed on a spine member which is attached to the first and second covers. The first and second covers of such embodiment include bound edges and oppositely disposed free edges. The bound edges are affixed to the spine member. The first closure member is positioned along the free edge of the first cover and the second closure member is adjacent the free edge of the second cover.

In several embodiments the first closure member includes a tab extending from the first cover and the second closure member includes an aperture in the second cover. In one embodiment, the tab further includes at least one engagement member extending from the tab. The aperture is preferably disposed angular to the second cover free edge in such embodiment. In other embodiments, the first and second closure members can include a hook and loop fastener or other similar arrangement to secure the covers in an article protecting relationship.

In preferred embodiments the device further includes a protective sheet disposed between at least one of the covers and the plurality of sheet-like articles.

In an alternative embodiment, the sheet-like articles have lateral edges and the first and second covers have bound edges and oppositely disposed free edges. In such embodiment, the first closure member extends from the free edge of the first cover and the second closure member is secured adjacent the free edge of the second cover. The first closure member extends over the lateral edges and the second cover free edge, whereby the lateral edges of the articles are protected. Such embodiment can also further include a protective sheet disposed between at least one of the covers and the plurality of sheet-like articles.

A particular use for the device is with photographs, especially candid photos. The device is also very useful for binding documents which are larger than candid photos and which have commonly-aligned edges. Such documents may be 8 ½ inches by 11 inches in size, for example.

Further details of the invention are set forth in the following detailed description and in the drawings.

DETAILED DESCRIPTION OF PREFERRED EMBODIMENTS

Figure 1:
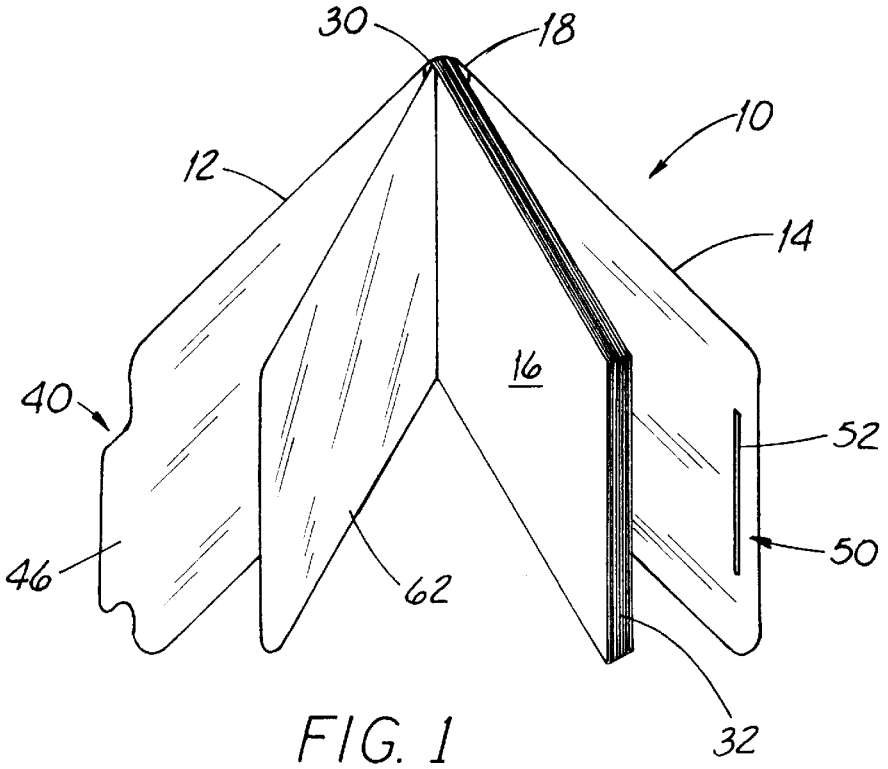
FIG. 1 is an isometric view of sheet-like articles, e.g., photographs, bound together using the inventive device.

As best seen in FIG. 1, the inventive device 10, includes a first cover 12 and a second cover 14 between which is placed a group of discrete sheet-like articles 16. A strip-like spine member 18 having pressure sensitive adhesive 36 disposed along its length adheres to both covers 12, 14 and to the articles 16 and binds them together "booklike" for easy article display.

Figure 2:
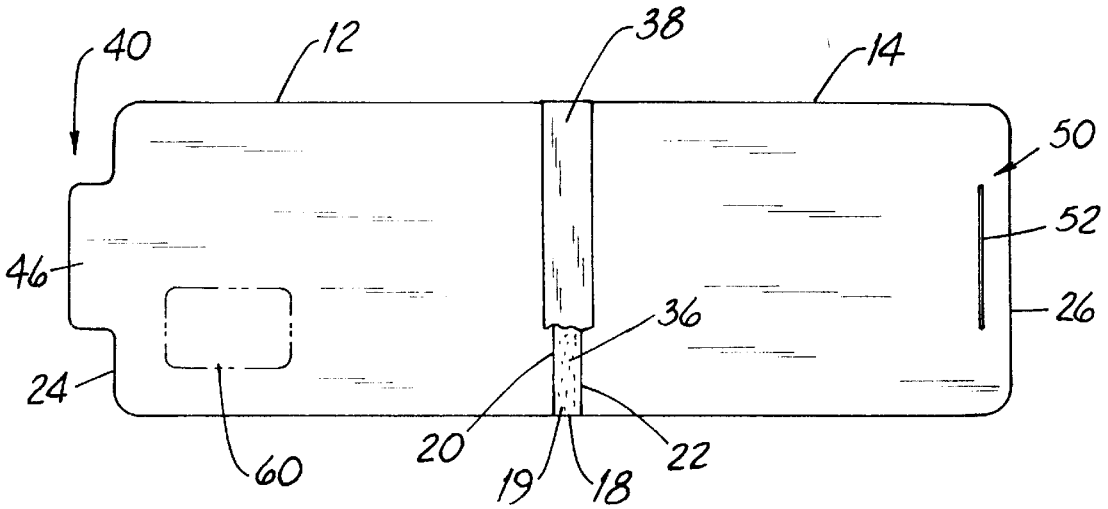
FIG. 2 is a plan view of the inventive device in an open position without the sheet-like articles bound thereto.

As shown in FIG. 2, covers 12 and 14 include cut and cut edges 20, 22, respectively, cut-edge-abutting outer surface portions, and oppositely disposed free edges 24, 26, respectively. Cut-edge-abutting outer surface portions, 20, 22 are attached to spine member 18 and as shown in FIG. 2, adhesive 36 extends to the bound edges 20, 22. As best seen in FIG. 2, a medial portion 19 of the spine member remains exposed between bound edges 20, 22 of the covers. The purpose of such medial portion 19 will become apparent hereinafter.

Figure 9:
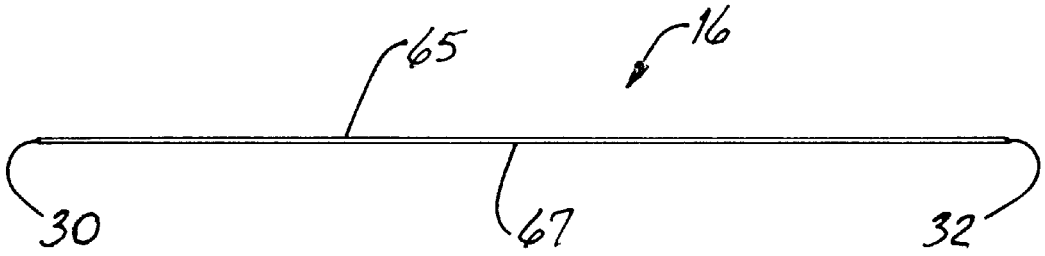
FIG. 9 is an edge view of a sheet-like article of the type bound by the device.

As shown in FIGS. 1 and 9 articles 16 include lateral edges 30, 32 and two parallel, generally planar surfaces 65, 67 "defined" by the edges 30, 32. Lateral edges 30 are adhesively secured to the device by pressure sensitive adhesive 36 disposed along the length of medial portion 19. Pressure sensitive adhesive 36 is preferably a releasable adhesive thereby enabling insertion, removal and reinsertion of articles 16 from the device. A protective release liner 38 can also be included to protect adhesive 36 prior to insertion of articles 16.

Device 10 further includes a first closure member 40 secured to first cover 12. Preferably, as shown in FIGS. 1 and 2, first closure member 40 is disposed along first cover free edge 24. Most preferably, first closure member 40 is centrally located along free edge 24. First closure member 40 preferably includes a tab or flap 46 extending from free edge 24. Tab or flap 46 and first cover 12 can be formed from a single piece of material or flap 46 can be provided as a separate piece attached to first cover 12 in any known manner. Tab 46 can be any number of dimensions.

Device 10 further includes a second closure member 50 disposed at second cover 12. Preferably, as shown in FIGS. 1 and 2, second closure member 50 is disposed along second cover free edge 26. Most preferably, second closure member 50 is centrally located along free edge 26.

Figure 3:
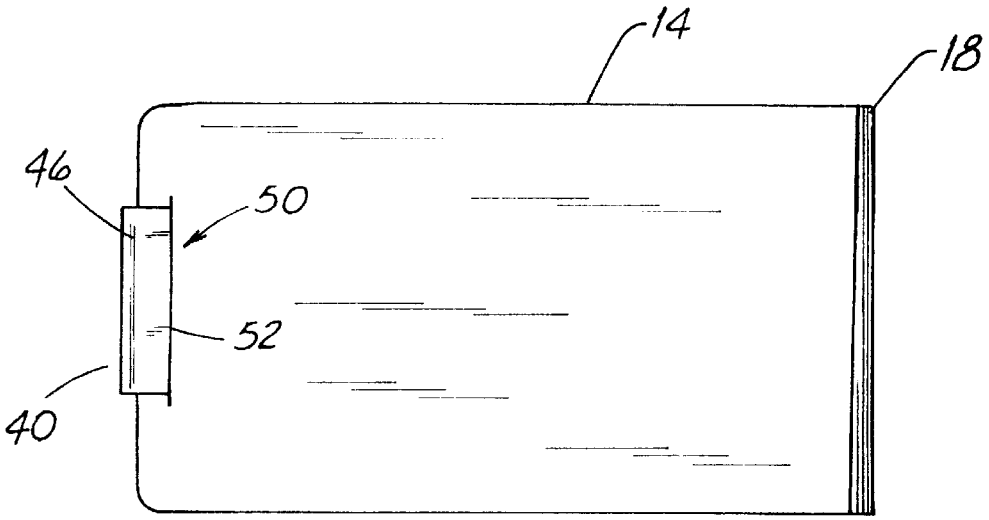
FIG. 3 is a plan view of the back side of an embodiment of the inventive device in a closed position.
Figure 5:
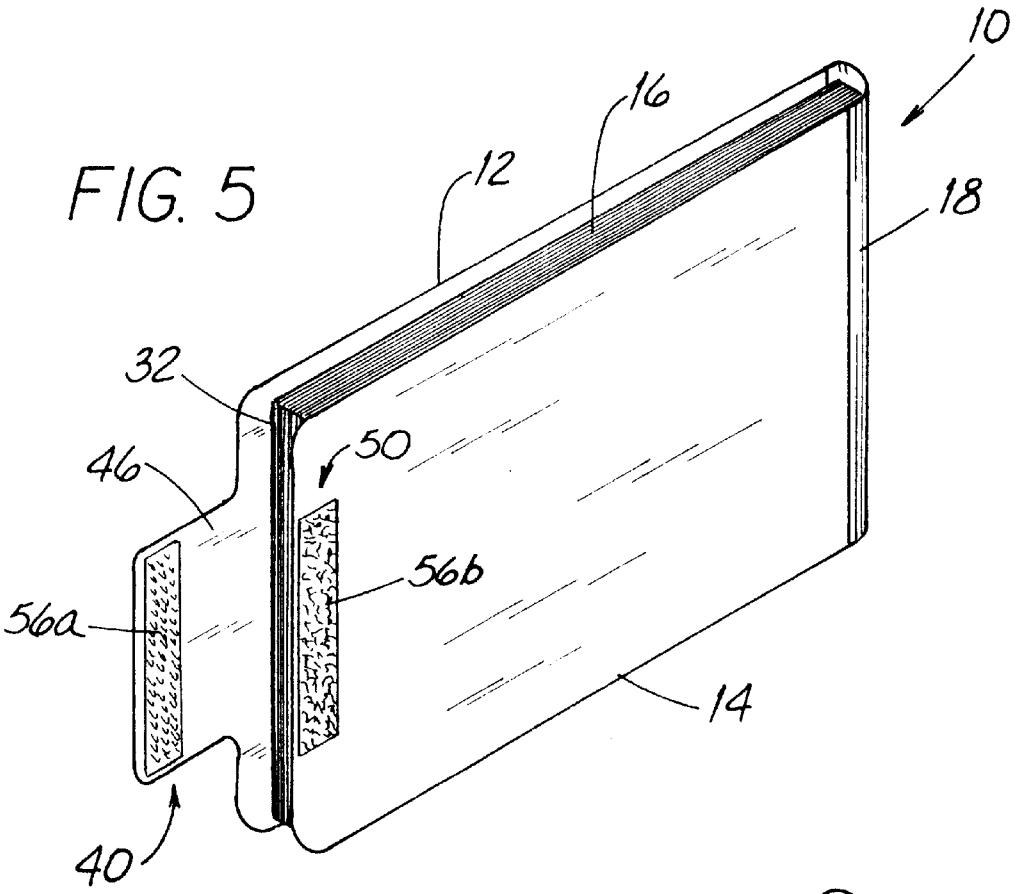
FIG. 5 is an isometric view of an embodiment of the inventive device prior to attachment of the first closure member to the second closure member.

First and second closure members 40, 50 are adapted to coact with one another to secure the covers 12, 14 in an article-protecting relationship. As best seen in FIGS. 3 and 5, first closure member 40 is adapted to extend over lateral edges 32 of the articles and be secured by second closure member 50. This arrangement greatly reduces damage to lateral edges 32 and prevents loosening or loss of articles from the device.

In one embodiment, shown in FIGS. 1 and 3, first closure member 40 is a tab 46 and second closure member 50 includes an aperture 52, such as a slot or the like. Tab 46 is adapted to be inserted into aperture 52 to secure the covers in an article-protecting relationship.

Figure 7:
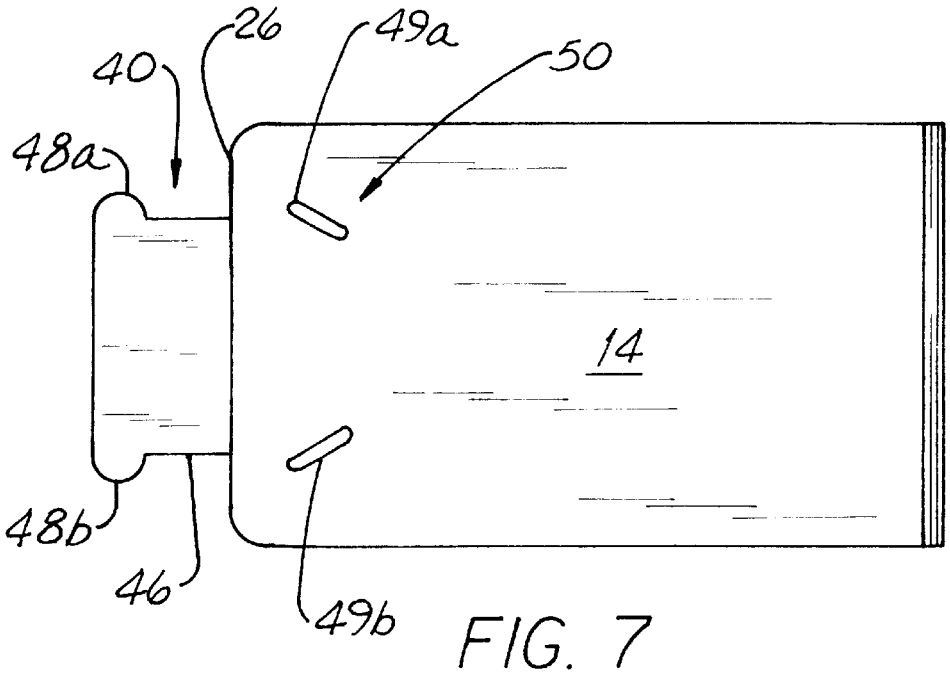
FIG. 7 is a plan view of the back side of another embodiment of the inventive device prior to attachment of the first closure member to the second closure member.
Figure 8:
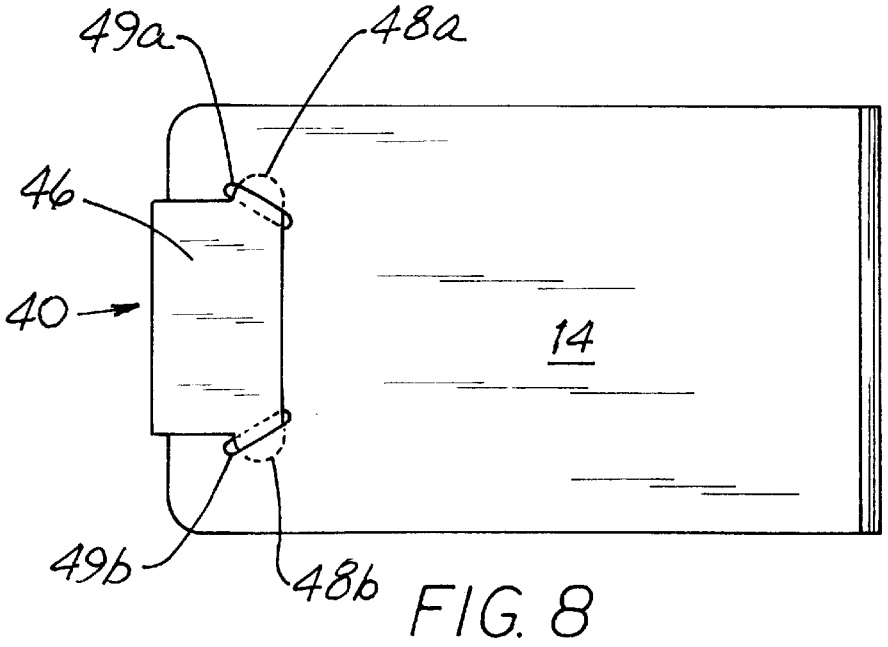
FIG. 8 is a plan view of the back side of another embodiment of the inventive device in a closed position.

In another embodiment shown in FIGS. 7 and 8, tab 46 includes a pair of engagement members 48*a* and 48*b* extending therefrom. Second closure member 50 includes a pair of slots 49*a* and 49*b* adapted to receive engagement members 48*a* and 48*b*. In preferred embodiments, slots 49*a* and 49*b* are angularly disposed with respect to free edge 26, although slots 49*a* and 49*b* can be disposed parallel or perpendicular to free edge 26. Additionally, a single engagement member and a single slot or aperture can be used to secure the covers in position.

Figure 4:
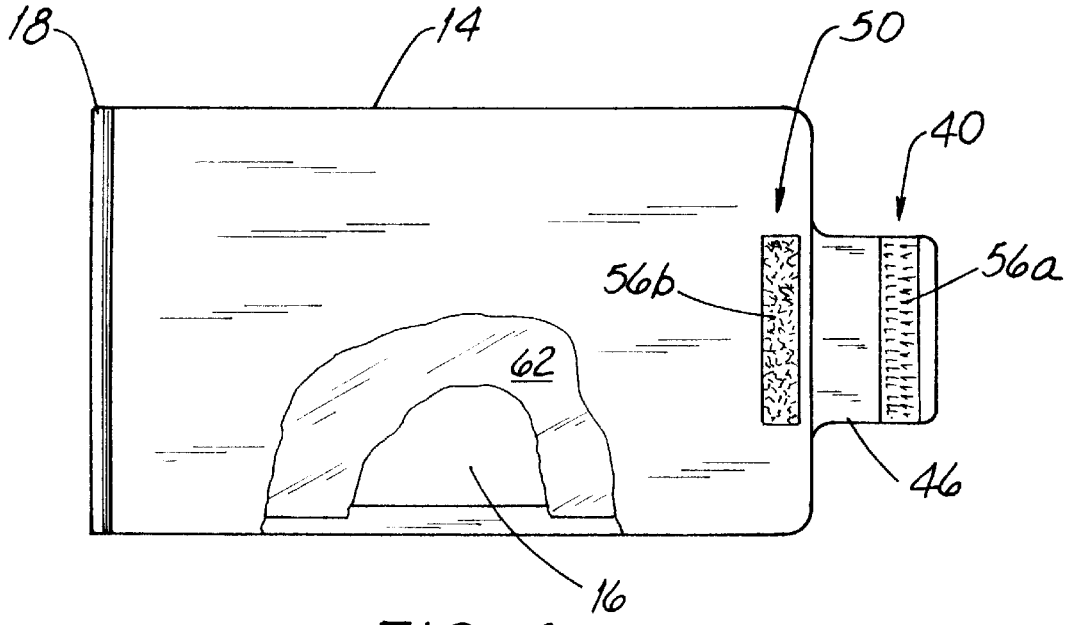
FIG. 4 is a plan view partially broken away of the front side of another embodiment of the inventive device in a closed position.

In alternative embodiments, shown in FIGS. 4 and 5, first closure member 40 and second closure member 50 can include complimentary portions of a hook and loop fastener 56*a* and 56*b* such as VELCRO®. Such hook and loop fastener 56 allows for more firm securement of first and second closure members 40, 50 together.

Figure 6:
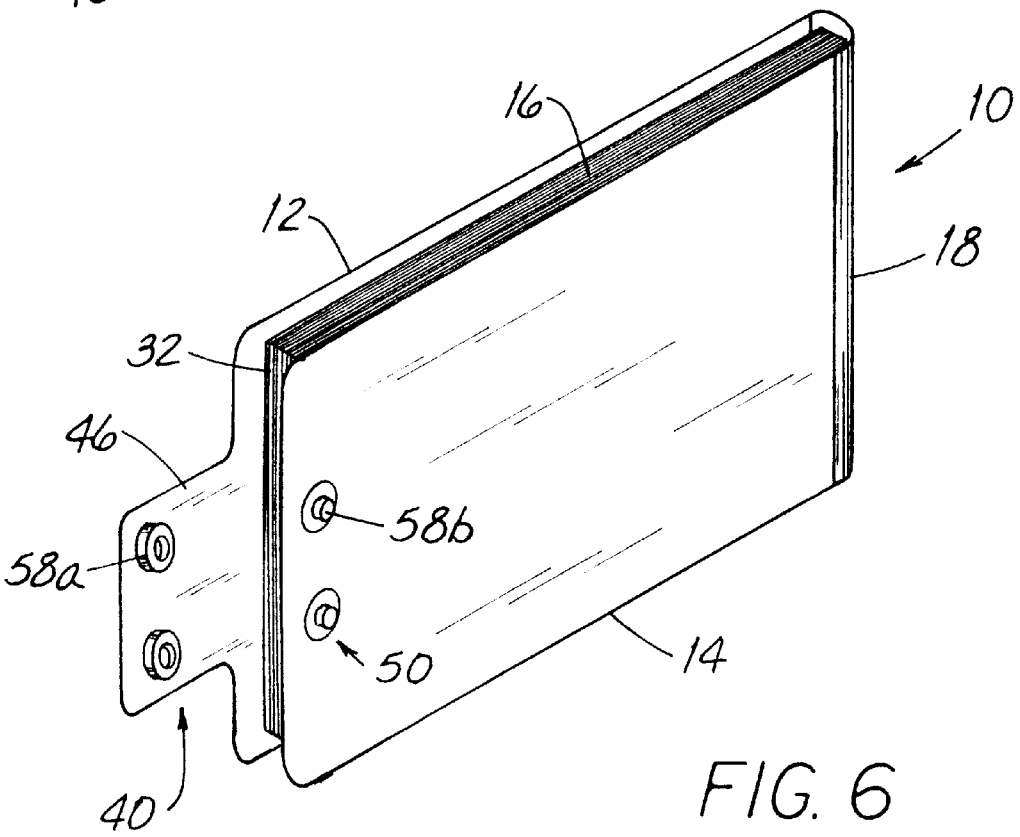
FIG. 6 is an isometric view of another embodiment of the inventive device prior to attachment of the first closure member to the second closure member.

In yet another embodiment, shown in FIG. 6, first closure member 40 and second closure member 50 can include complimentary portions of a snap arrangement 58*a* and 58*b*. This arrangement also allows for more firm securement of first and second closure members 40, 50 together. Other suitable arrangements for the first and second closure members are contemplated including a releasable adhesive arrangement or any other arrangement which provides for more secure attachment of the closure members together.

As seen in the various figures, first cover 12 can be either the front or back cover of the device. Such provides for first closure member 40 to extend either from front to back or back to front for attachment to second closure member 50. Either arrangement provides satisfactory results.

Further, as shown in FIG. 2, one of covers 12 or 14, or both can include a window-like opening 60 for viewing a portion of articles 16 therethrough. Opening 60 can be located at any position on the covers and be of any dimension not greater than the dimension of a cover.

The device 10 can be of any dimension depending on the number of articles to be bound. Likewise, covers 12 and 14 can be of any dimension depending on the size of the articles to be bound. For example, letter size documents of 8½"×11", legal size documents of 8½"×14", photographs of 3½"×5", postcard size, business card size, etc. Additionally, covers 12 and 14 can be of any suitable flexible material including leather, vinyl, plastic, paper, etc. Particularly, where photographs or other articles 16 having cut edges are to be bound it may be desirable to provide at least one transparent cover, so that the first photograph or an identifying cover sheet can be viewed therethrough.

Additionally, as best seen in FIGS. 1 and 4, a protective sheet 62 can be included on top of the stack of articles 16. Protective sheet 62 can be opaque or transparent and of any suitable material. Such protective sheet 62 prevents adhesive 36 from contacting the front of the first sheet-like article 16.

It is contemplated, particularly where candid photographs are to be bound, to include a sheet containing a pouch for photo negatives to be stored with the photographs. Because of the dimension of such negatives, covers 12 and 14 would be of larger dimension than, for instance 3½"×5" photographs. Additionally, such sheet can include preprinted information such as negative reorder information etc. on one side thereof.

While the principles of the invention have been described in connection with specific embodiments, it is to be understood clearly that such embodiments are by way of example and are not limiting.

What is claimed:

1. A device for binding sheet-like articles, such device comprising first and second covers, a plurality of discrete sheet-like articles interposed between the covers and releasably secured therebetween enabling insertion, removal and reinsertion of the sheet-like articles and wherein:

the device includes a folding spine member having the adhesive thereon;

the folding spine member is elongated and has first and second opposed edges, first and second edge-adjacent portions, and a middle portion therebetween;

an adhesive extends from the first edge to the second edge of the spine member;

the first and second covers are made of a durable material and include respective cut edges, cut-edge-abutting outer surface portions and oppositely-disposed free edges;

the cut edges of the first and second covers are spaced from one another and the adhesive contacts an area of the cut-edge-abutting outer surface portions so as to permanently attach the covers to the spine member thereby creating a book-like binding;

each of the articles has a lateral cut-and-bound edge and parallel, substantially planar surfaces delimited thereby;

the lateral cut-and-bound edges of the articles are aligned in registry with one another;

the planar surfaces of the articles are free of the adhesive;

the adhesive being releasable with respect to edge contact; and the adhesive contacts only the lateral cut-and-bound edges of the articles, whereby the durable covers are attached to the spine member to form a permanent book having articles that can be readily removed from and reattached to the spine member.

2. The device of claim 1 wherein:

the spine member is a tape having the adhesive on only a single side thereof; and the spine member retains the cut and bound edges of the first and second covers in a spaced relationship to one another.

3. The device of claim 1 further including a protective sheet disposed between the first cover and the plurality of sheet-like articles and having an edge adhering to the releasable adhesive on the spine member, thereby allowing the sheet to be removed from and re-attached to the spine member.

4. The device of claim 1 wherein the articles are photographs, and wherein:

each article has a lateral free edge spaced from the lateral cut-and-bound edge;

each article has a blank undersurface extending between the lateral cut-and-bound edge and the lateral free edge;

the undersurface is free of adhesive; and the lateral cut-and-bound edges adhere to the releasable adhesive on the spine member, thereby allowing the photographs to be removed from and re-attached to the spine member.

* * * * *

UNITED STATES PATENT AND TRADEMARK OFFICE

CERTIFICATE OF CORRECTION

PATENT NO. : 6,000,722

DATED : December 14, 1999

INVENTOR(S) : Richard S. Werner and Serge Marini

It is certified that error appears in the above-identified patent and that said Letters Patent is hereby corrected as shown below:

Col. 4, line 3
replace ""defined""
with --"delimited"--.

Signed and Sealed this

Eighth Day of August, 2000

*Attest:*

*Attesting Officer*

Q. TODD DICKINSON

*Director of Patents and Trademarks*